United States Patent [19]

Mead

[11] Patent Number: 4,944,404

[45] Date of Patent: Jul. 31, 1990

[54] FRAME STRUCTURE

[75] Inventor: Peter L. Mead, Middlewich, Great Britain

[73] Assignee: Lin Pac Mouldings Limited, Birmingham, Great Britain

[21] Appl. No.: 331,497

[22] Filed: Mar. 31, 1989

[30] Foreign Application Priority Data

Apr. 8, 1988 [GB] United Kingdom ..... 8808272.2

[51] Int. Cl.[5] ..... B65D 19/00

[52] U.S. Cl. ..... 206/600

[58] Field of Search ..... 206/517, 600, 509, 511, 206/512, 386

[56] References Cited

U.S. PATENT DOCUMENTS

| | | | |
|---|---|---|---|
| 3,283,943 | 11/1966 | Cargnelutti | 206/509 |
| 4,174,046 | 11/1979 | Atkins | 206/600 X |
| 4,491,231 | 1/1985 | Heggeland et al. | 206/511 X |
| 4,809,851 | 3/1989 | Oestreich, Jr. et al. | 206/511 X |

FOREIGN PATENT DOCUMENTS

| | | | |
|---|---|---|---|
| 2038278 | 7/1980 | United Kingdom | 206/600 |

*Primary Examiner*—William I. Price

[57] ABSTRACT

A frame structure (1) having an open top and an open bottom is for mounting on a pallet (6) to form a plastics retaining wall. The side walls (2 and 3) of the frame have upwardly extending flanges (16, 16*a* and 17) at the top edge and downwardly extending flanges (7, 7*a* and 8) at the bottom edge. Two similar frame (1) are stackable, one on the other to extend the height of the wall with the downwardly extending flanges of the upper structure received between the upwardly extending flanges of the lower structure so that the flanges bridge both frames to restrain relative horizontal displacement therebetween. The flanges (7 and 16) have apically profiled edge parts (30) which snap engage between respective structures in forming the stack to restrain the upper frame from lifting relative to the lower frame. The frame strucutre may be collapsible to form a flat pack.

16 Claims, 3 Drawing Sheets

9
4
15
2b
15
16
17
2
30
9
2a
5
16a
8
3
16
17
1
30
16
7
4
12
12
30
2a
4
15
7a
17
7
16
7a
16a
17
8
30
5
30
7
12
3
4
8
6
30
2
2b 2a
2b
16
30
17
3
4
30
5
16
17
1
30
7
30
3
30
2b
7a
4
4
7
2a
30

FRAME STRUCTURE

TECHNICAL FIELD AND BACKGROUND ART

The present invention relates to a frame structure of the type having an open top and an open bottom and adapted to be mounted on a base to form an upstanding retaining wall. Frame structures of the type mentioned are well known for the purposes of storage and transport of goods where the base is often in the form of a pallet or may indeed be another frame structure which itself is mounted on a pallet so that the overall height of the retaining wall provided by the structures is increased. Typically the frame structure will be of a rectangular configuration in plan. The structure may also be collapsible into a substantially compact and flat pack to facilitate transport and storage of the structure when not in use. An example of a frame structure having these latter characteristics is disclosed in our British Patent Publication No. 2,179,320.

With a frame structure of the type referred to above, it is desirable that when two similar such structures are mounted one on the other to form a hollow column, the overall assembly of the frames should have a stable configuration so that the individual structures are unlikely to be inadvertently dislodged during the use. Furthermore, this desirable characteristic of assembly should be achieved in a simple, inexpensive and convenient, straightforward manner without the necessity of using tools or ancillary equipment and yet permit the frame structure to be removed from the overall assembly in a similar straightforward and convenient manner. It is an object of the present invention to provide a frame structure which satisfies the aforementioned requirements.

STATEMENT OF INVENTION AND ADVANTAGES

According to the present invention there is provided a frame structure having an open top and an open bottom and which is adapted to be mounted on a base to form an enclosed upstanding plastics retaining wall; the retaining wall having a top edge and a bottom edge so that two similar frame structures can be mounted one on the other to form a hollow column with the bottom edge of the upper structure sitting on the top edge of the lower structure; peripherally spaced upwardly extending flanges on the wall adjacent to its open top and peripherally spaced downwardly extending flanges on the wall adjacent to its open bottom, the downwardly extending flanges being offset from the upwardly extending flanges on the respective walls whereby when two structures are mounted to form said hollow column the seated top and bottom edges are bridged by said upwardly and downwardly extending flanges to restrain the two frame structures from horizontal displacement relative to each other and wherein at least one of the upwardly extending flanges and at least one of the downwardly extending flanges have a profiled edge part, said profiled edge parts engaging between flanges of the two structures during location of the upper structure on the lower structure in forming said column to restrain the upper structure from lifting relative to the lower structure.

By the present invention the upwardly and downwardly extending flanges are disposed so that when two similar frame structures, which will usually be injection moulded in the plastics material, are stacked one on the other to form a hollow column, the flanges bridge between the two structures to stabilise the column horizontally in a manner disclosed in our British Patent Specification No. 2,179,320. Further by the present invention however, at least one of the downwardly extending flanges and at least one of the upwardly extending flanges are each provided with a profiled edge part, these parts co-operate and engage during seating of the upper frame structure on the lower frame structure so that the two structures are stabilised vertically (that is the engagement between the profiled edge parts of the respective flanges restrains the upper structure from being lifted, inadvertently, from the lower structure). The co-operation between the profiled edge parts is preferably such as to provide snap engagement between those parts as permitted by the resilient nature of the plastics material from which the frame structures are formed (but not necessarily wholly formed). It is also preferred that the engaging edge parts are profiled so that the snap engagement is achieved automatically as the upper frame structure is lowered vertically onto a similar underlying frame structure and by the weight of the upper frame structure (and possibly the application of a little manual effort applied vertically to the upper frame). Desirably the edge parts of the engaging flanges are profiled so that the two frames are separable merely by the application of reasonable manual effort to lift the upper frame directly off the lower frame and thereby displacing the appropriate flanges having the profiled edge parts against their resilient biasing to achieve the disengagement. To achieve the preferred snap engagement and disengagement of the profiled edge parts as discussed above, those parts are preferably tapered to have an apical profile in a vertical plane so that the inclined edges of the profile provide a smooth lead-in surface for snap engagement between two flanges and also provide an appropriate reaction to displace the flanges out of engagement with each other upon separation of two frames.

When intended for mounting on a pallet base the frame structure will usually be of rectangular configuration in plan (although it will be appreciated that other configurations can be used such as circular or polygonal in plan). Preferably the upwardly and downwardly extending flanges are peripherally spaced and disposed so that the frame structure can be mounted and engaged on a similar underlying structure with one structure either end up relative to the other structure. Furthermore, it is preferred that the flanges and the profiled edge parts of the flanges are disposed so that stacking of two similar frame structures can be achieved with the lower frame disposed in any one of two or more positions in a horizontal plane relative to the upper frame; for example with a frame structure which is of oblong rectangular configuration in plan, the flanges and profiled edge parts are preferably disposed so that two such frames can be column stacked with the frames similarly orientated in overlying relationship or with one frame rotated in a horizontal plane through 180° relative to the other frame. The frame structure will usually have two or more upwardly extending flanges and two or more downwardly extending flanges each of which has a profiled edge part for engaging between the flanges of the two frame structures in extending the height of the retaining wall.

To achieve the preferred snap engagement between the co-operating profiled edge parts of two frame structures there will be a reaction between those structures during resilient displacement of the profiled flanges. During this reaction the two frame structures have to be restrained from excessive horizontal displacement relative to each other; this restraint may be achieved by the one or more flanges which bridge between the two frames and which flanges may be plain or themselves include engaging profiled edge parts.

The upwardly and downwardly extending flanges of the frame structure may be located on either the inner or outer side of the enclosed retaining wall so that the flanges are located either on the inside or the outside of the hollow column formed by two or more stacked frames. Indeed it is possible to have on each frame structure flanges located on both the inner side and the outer side of the retaining wall provided that the required engagement is permitted between profiled edge parts of at least some flanges as previously discussed.

There is further provided the combination of a frame structure as specified above as being in accordance with the present invention and a base on which the bottom edge of the frame structure sits so that the structure forms an upstanding retaining wall enclosure on the base, said base being in the form of a pallet having peripherally spaced upwardly extending plastics flanges, the downwardly extending flanges on the frame structure bridging with the pallet and the upwardly extending flanges on the pallet bridging with the frame structure to restrain the frame structure and pallet from horizontal displacement relative to each other, and wherein at least one of the upwardly extending flanges on the pallet has a profiled edge part which engages with a profiled edge part on the frame structure during location of the frame structure on the pallet to restrain the frame structure from lifting relative to the pallet.

Preferably but not essentially, the frame structure is collapsible to form a substantially compact pack. Where the frame structure is of rectangular configuration in plan comprising a pair of opposed end walls connected to respective ones of a pair of opposed side walls, each of the end walls may be displaceable inwardly from an erect condition of the frame structure by pivotal movement about vertical hinges on the side walls and to a position between and parallel with the opposed side walls for collapsing the structure to a flat pack.

DRAWINGS

One embodiment of a collapsible plastics frame structure constructed in accordance with the present invention will now be described, by way of example only, with reference to the accompanying illustrative drawings in which.

Figure 4:
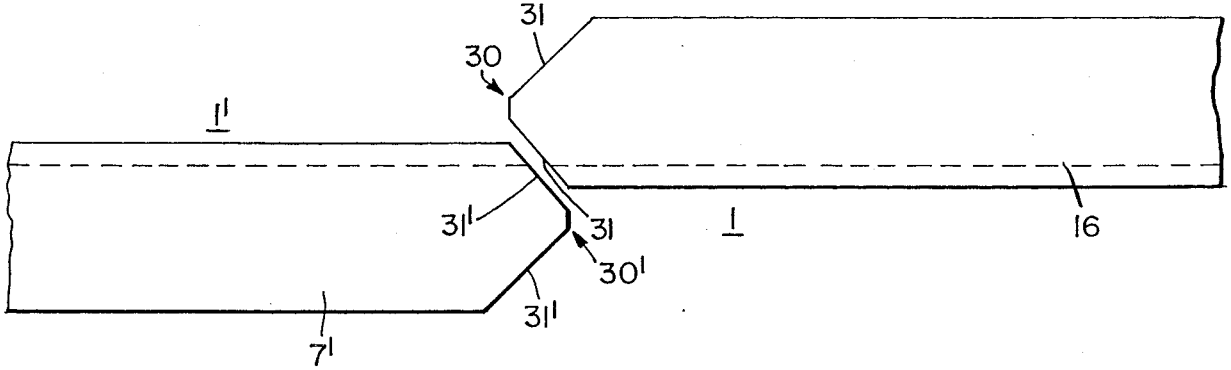
Figure 5:
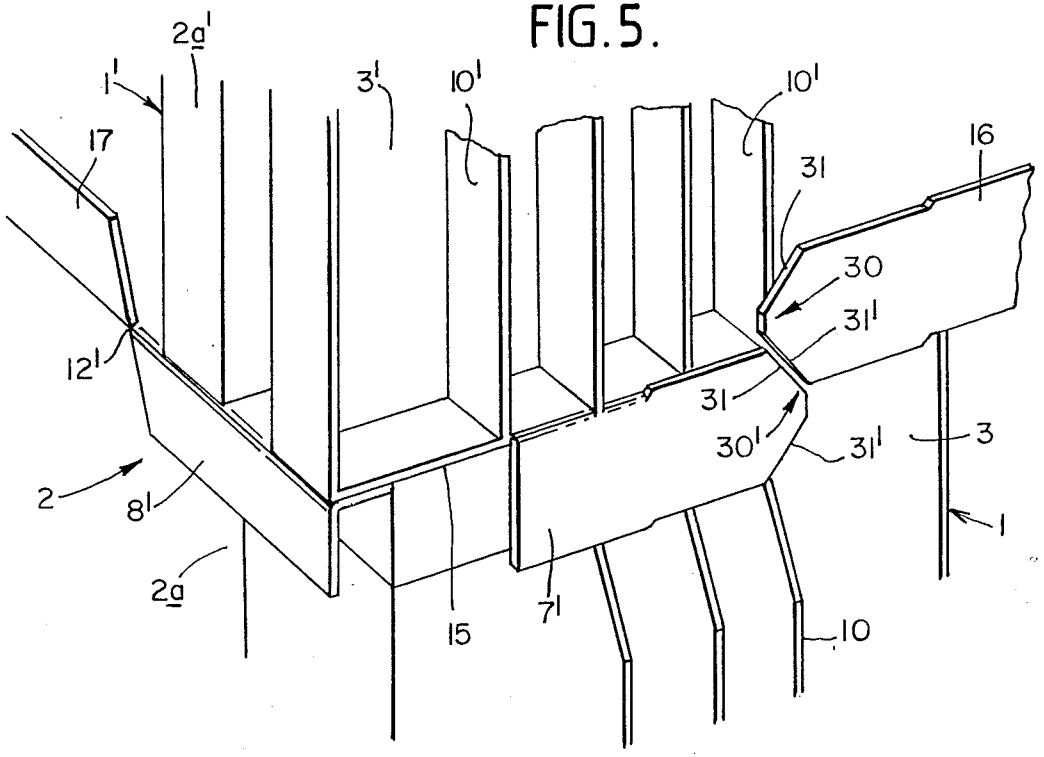

FIG. 4 is a side view diagrammatically illustrating the manner in which the profiled edge parts of two column stacked frame structures engage to restrain the structures from vertical displacement, and FIG. 5 is a perspective view of a corner part of two column stacked frame structures, again diagrammatically illustrating the engagement between profiled edge parts on the structures in a similar manner to that shown in FIG. 4.

DETAILED DESCRIPTION OF DRAWINGS

Figure 1:
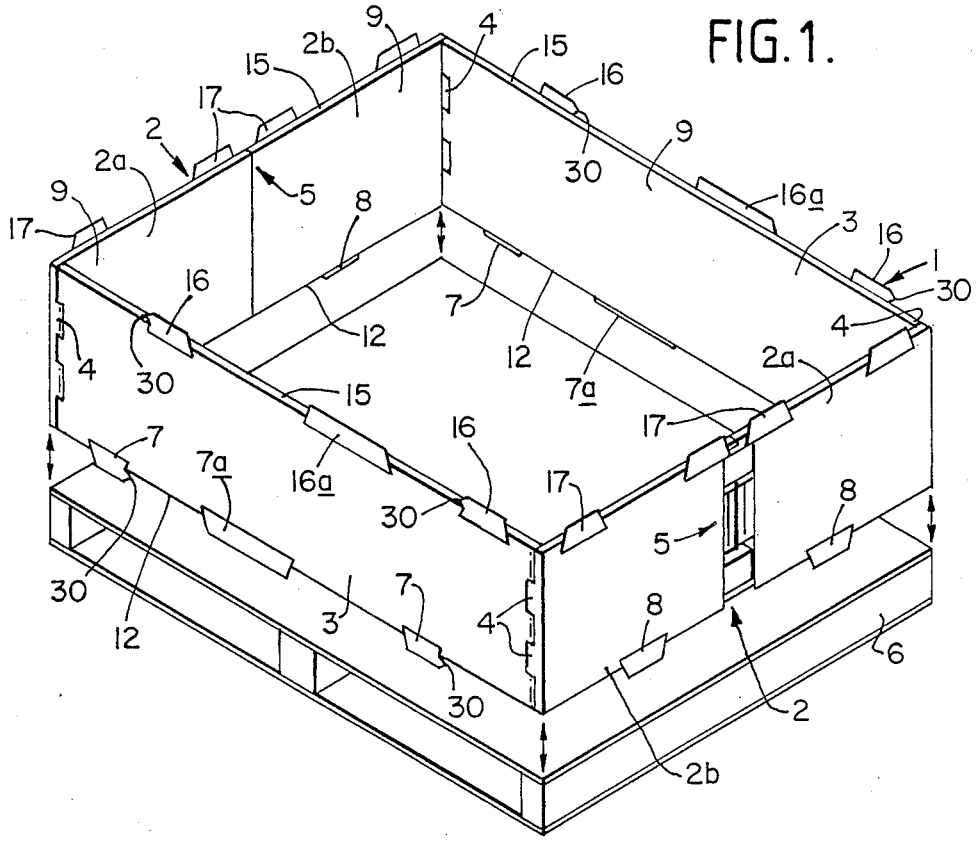
FIG. 1 is a perspective view of the structure in an erect condition and being mounted on a pallet to form an upstanding retaining wall of rectangular configuration in plan.
Figure 2:
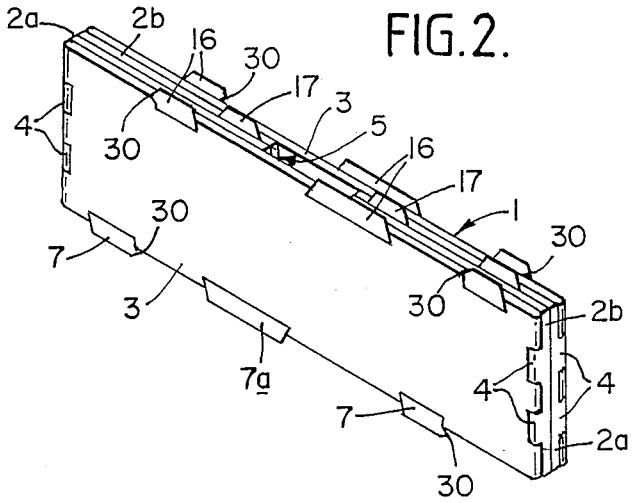
FIG. 2 shows the frame structure of FIG. 1 collapsed as a compact and flat pack.

The frame structure 1 when erect as shown in FIG. 1 is similar to that disclosed in our British Patent Specification No. 2,179,320 and has a configuration which is rectangular in plan being formed by a pair of opposed end walls 2 and a pair of opposed longer side walls 3. The end walls 2 are vertically hinged at 4 to the respective side walls 3. Each end wall 2 is formed with two wall parts 2*a* and 2*b* which are pivotally connected together as shown at 5 in the central part length region of the respective end walls 2. The hinged and pivotal connections 4 and 5 permit the frame structure to be collapsed from its erect condition shown in FIG. 1 by displacement of the end walls 2 inwardly between the side walls 3 so that the walls and wall parts are located in substantially parallel planes and in overlying and abutting relationship to form a compact and flat pack (as shown in FIG. 2) which is convenient for the purposes of storing or transporting the frame structure when not in use. The particular hinged connections between the walls and wall parts of the frame structure 1 to permit collapsing of the structure from the condition shown in FIG. 1 to that shown in FIG. 2 are illustrated and discussed in detail in our British Specification No. 2,179,320 and as such need not be further described herein.

When in its erect condition as shown in FIG. 1, the frame 1 is intended to be mounted on a base which is shown as a conventional form of pallet 6 having a rectangular deck which corresponds in size to that of the frame so that the bottom edge 12 of the latter sits on the periphery of the pallet deck.

The side walls and end walls 2 and 3 are provided with a peripherally spaced array of downwardly extending flanges 7, 7*a* and 8 on the exterior thereof. These flanges bridge with the pallet 6 and overlie the side edge of the pallet to restrain the frame structure from being displaced horizontally over the deck of the pallet. In addition the flanges 8 on the end wall parts 2*a* and 2*b* restrain the end wall parts from being displaced inwardly from the rectangular configuration while the frame is mounted on the pallet. By this arrangement the erect frame structure 1 provides an upstanding retaining wall for goods carried on the pallet.

The side walls and end walls are also provided with a peripherally spaced array of flanges 16, 16*a* and 17 which extend upwardly from the upper parts of the side and end walls and on the exterior of those walls to a position above the top edge 15 of the walls.

The end wall parts 2*a*, 2*b* and side walls 3 (including their respective upwardly and downwardly extending flanges) are formed by plastics mouldings of substantial thickness. Typically the walls and wall parts will have substantially flat inner surfaces 9 which are smooth (and may be continuous over that wall so that the inner surface is located on a sheet or web of the wall or may be apertured so that the walls are in the form of open frameworks) while the exterior of the walls and wall parts is provided with reinforcing ribs 10 (which for convenience have been omitted from FIGS. 1 and 2 but are indicated in FIG. 5).

The upwardly extending flanges 16, 16*a* and 17 are provided for the purpose of stacking two or more similar frame structures one on top of the other in overlying relationship as a vertical hollow column to extend the height of the retaining wall on the pallet 6. To increase the height as aforementioned and with a bottom frame 1 on the pallet 6, a similar upper frame 1' (indicated partly in FIGS. 4 and 5 where the parts on the frame 1' which correspond to those on the frame 1 have been indicated by the same reference numerals 1 but with a dash) is lowered vertically so that its bottom edge 12' sits on the upper edge 15 of the lower frame 1. From FIG. 1 it will be seen that the upwardly extending flanges 16, 16*a* and 17 are offset from (in the sense that they are not vertically above) the downwardly extending flanges 7, 7*a* and 8 so that the flanges 7', 7*a'* and 8' of the upper frame are received between the flanges 16, 16*a* and 17 of the bottom frame and these flanges bridge between and lie closely against the outside of both frames. Consequently, the upper frame 1' is restrained, by the flanges which extend between it and the bottom frame 1, from displacement horizontally relative to the lower frame. Furthermore, the bridging of the downwardly extending flanges 8' on the upper frame over the end walls 2 of the bottom frame restrain the end wall parts 2*a'* and 2*b'* of the upper frame from displacement inwardly and therefore restrain the upper frame from collapsing.

The upwardly and downwardly extending flanges on the side walls of the frame are generally in the form of substantially flat elongated plates. The longitudinal extent of each plate is parallel with the top and bottom edges of the wall on which it is located and the plates extend upwardly or downwardly, as appropriate, in planes that are substantially parallel with the planes of the respective walls on which they are located.

For the purpose of restraining the upper frame 1' from lifting off the bottom frame 1 when their respective bottom and top edges 12 and 15 are seated one on the other, upwardly and downwardly extending flanges on the opposed side walls 3 are provided with profiled edge parts which are intended to co-operate for snap engagement between the two frames during their erection to increase the height of the retaining wall. In the present example the upwardly extending flanges 16 and downwardly extending flanges 7 are each provided with an edge part 30 which forms an apical profile at an end of the respective flanges. Each apical profile 30 is formed by side edges 31 (see FIGS. 4 and 5) which converge in the plane of their respective flanges. From FIG. 3 it will be seen that although the flanges 16 and 7 are vertically off-set from each other, the profiled edge parts 30 vertically overlie each other to a small extent as necessary to achieve snap engagement between two frames as will now be described.

During vertical stacking and as the upper frame 1' is lowered onto the top edge of the bottom frame 1, the lowermost side edges 31' on the downwardly extending flanges 7' of the upper frame abut the uppermost side edges 31 of the upwardly extending flanges 16 on the bottom frame. By the application of reasonable manual force to press the upper frame 1' downwardly to the lower frame 1, the abutting side edges 31 and 31' of the respectively cooperating flanges slide over each other. The flanges 7' and 16 are displaced against the resilience of the plastics from which the walls are moulded until they snap engage whereby the upwardly directed side edges 31' of the flanges 7' for the upper frame move to a position beneath and opposing the downwardly directed edges 31 of the flanges 16 on the bottom frame (as shown in FIG. 4).

Figure 3:
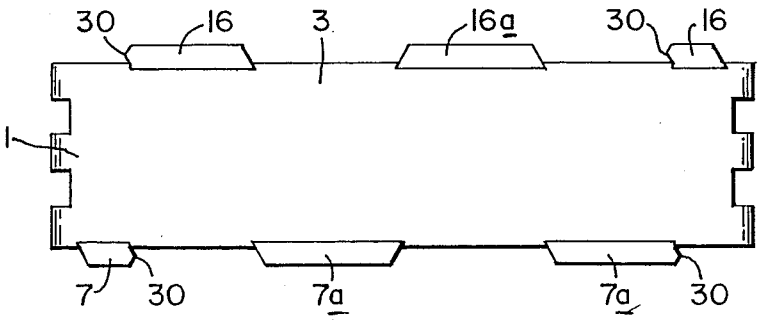
FIG. 3 is a side elevation of the frame structure particularly illustrating the profile and disposition of flanges and profiled edge parts for such flanges on each side wall of the structure.

To achieve the snap engagement as mentioned above it will be appreciated that the respectively engaging pairs of flanges 16 and 7' have to be displaced horizontally against the resilience of the plastics material from which the frames are moulded. Having this in mind, in the present example, the reaction from the snap engagement as previously described is taken by the abutment of the downwardly extending flanges 8' of the upper frame against the end wall parts 2*a* and 2*b* of the lower frame 1 (this is best seen in FIG. 5). The aforementioned reaction between the flanges 8' and the appropriate end wall 2 to restrain the upper frame from horizontal displacement on the bottom frame results from the fact that the profiled edge parts 30 are similarly orientated on the respective flanges 16 and on the respective flanges 7 (as seen in FIG. 3). However if, for example in FIG. 3, the lefthand flange 16 is reversed (so that its profiled edge part 30 is located at the righthand end of that flange) and similarly a profiled edge part is located at the lefthand end of the downwardly extending flange 7*a*, it will be appreciated that during snap engagement of the flanges in a manner similar to that previously described, the reaction from that engagement is substantially equal and opposite between the two upwardly extending flanges 16 on each side wall 3.

The inclined side edges 31 on the flanges provide a convenient lead-in for the snap engagement between the respective pairs of flanges. When it is required to reduce the height of the retaining wall, the upper frame can be separated from an underlying frame simply by lifting the upper frame manually and with sufficient force so that the respectively engaging flanges 7' and 16 are displaced horizontally against the resilience of the plastics material to disengage the flanges from between the frames. Again, the inclination of the side edges 31 and 31' provide lead-in surfaces which facilitate the aforementioned disengagement.

From FIG. 1 it will be seen that the upwardly and downwardly extending flanges are disposed with respect to the top and bottom edges of the frame so that the upper frame 1' can be located on the bottom frame 1 either with the upper and lower frames similarly orientated or with one of those frames rotated through 180° in a horizontal plane relative to the other frame. Also the two frames can be engaged with either frame inverted top-to-bottom with respect to the other.

The pallet 6 can be provided with upwardly extending plastics flanges (not shown) which are shaped with edge parts 30 similarly to the flanges 16 and which are positioned to correspond with the flanges 16 for the purpose of engaging with the downwardly extending flanges 7 on the bottom frame structure to restrain the frame from lifting off the pallet deck.

I claim:

1. A frame structure having an open top and an open bottom and which is adapted to be mounted on a base to form an enclosed upstanding plastics retaining wall; the retaining wall having a top edge and a bottom edge so that two similar frame structures can be mounted one on the other to form a hollow column with the bottom edge of the upper structure sitting on the top edge of the lower structure; peripherally spaced upwardly extending flanges on the wall adjacent to its open top and peripherally spaced downwardly extending flanges on the wall adjacent to its open bottom, the downwardly extending flanges being offset from the upwardly extending flanges on the respective walls whereby when two structures are mounted to form said hollow column the seated top and bottom edges are bridged by said upwardly and downwardly extending flanges to restrain the two frame structures from horizontal displacement relative to each other and wherein at least one of the upwardly extending flanges and at least one of the downwardly extending flanges have a profiled edge part, said profiled edge parts engaging between flanges of the two structures during location of the upper structure on the lower structure in forming said column to restrain the upper structure from lifting relative to the lower structure.

2. A frame structure as claimed in claim 1 in which the profiled edge parts provide for snap engagement between downwardly extending flanges and upwardly extending flanges respectively of two similar frame structures are mounted one on the other.

3. A frame structure as claimed in claim 1 in which the edge parts are profiled so that engagement between the respective flanges is achieved automatically as an upper frame is lowered on to a similar underlying frame structure.

4. A frame structure as claimed in claim 1 in which the edge parts are profiled so that disengagement of two similar frame structures whose edge parts engage is achieved automatically by lifting the upper frame manually from the lower frame.

5. A frame structure as claimed in claim 1 in which the profiled edge parts have inclined side edges which abut and move over each other during engagement of the profiled edge parts on upper and lower frame structures to facilitate cooperation and snap engagement between the flanges.

6. A frame structure as claimed in claim 5 in which the profiled edge parts have a substantially apical profiles in a vertical plane.

7. A frame structure as claimed in claim 1 in which the profiled edge parts provide for snap engagement between flanges of upper and lower frame structures and said snap engagement results in a horizontal reaction which is countered by an opposing horizontal reaction between a downwardly extending flange on the upper frame structure abutting the lower frame structures.

8. A frame structure as claimed in claim 7 in which the counter-reaction is provided by snap engagement between upwardly and downwardly extending flanges of the respective upper and lower frame structures.

9. A frame structure as claimed in claim 1 and which is of rectangular configuration in plan.

10. A frame structure as claimed in claim 1 in which the upwardly and downwardly extending flanges are peripherally spaced and disposed so that the frame structure can be mounted on and engage with a similar underlying structure with one structure the same way up as, or inverted vertically relative to, the other structure.

11. A frame structure as claimed in claim 1 in which the upwardly and downwardly extending flanges are peripherally spaced and disposed so that profiled edge parts of the flanges can engage between two vertically stacked frame structures with the upper frame structure orientated in any one of two or more positions in a horizontal plane relative to the lower frame.

12. A frame structure as claimed in claim 11 in which the frame structure is of rectangular configuration in plan and the flanges and profiled edge parts are disposed so that two similar frames can be vertically stacked with the frames similarly orientated or with one frame rotated in a horizontal plane through 180° relative to the other frame.

13. A frame structure as claimed in claim 1 and having at least two upwardly extending flanges and at least two downwardly extending flanges which have profiled edge parts for engaging with similar frame structures in forming a hollow column.

14. A frame structure as claimed in claim 1 in which the flanges are located on the outer side of the wall or walls thereof.

15. A frame structure as claimed in claim 1 and which is collapsible to form a substantially compact pack.

16. The combination of a frame structure as claimed in claim 1 and a base on which the bottom edge of the frame structure sits so that the structure forms an upstanding retaining wall on the base, said base being in the form of a pallet and the downwardly extending flanges bridge with sides of the pallet to restrain relative horizontal displacement between the pallet and the frame structure.

* * * * *